US011490707B2

(12) United States Patent
Montoli

(10) Patent No.: US 11,490,707 B2
(45) **Date of Patent: *Nov. 8, 2022**

(54) AIRTIGHT COMPACT

(71) Applicant: Seacliff Beauty Packaging & Laboratories, Inc., Irvine, CA (US)

(72) Inventor: Antonio Montoli, Varese (IT)

(73) Assignee: SeaCliff Beauty Packaging & Laboratories, Inc., Irvine, CA (US)

( * ) Notice: Subject to any disclaimer, the term of this patent is extended or adjusted under 35 U.S.C. 154(b) by 928 days.

This patent is subject to a terminal disclaimer.

(21) Appl. No.: 16/200,768

(22) Filed: Nov. 27, 2018

(65) Prior Publication Data

US 2019/0116957 A1 Apr. 25, 2019

Related U.S. Application Data

(63) Continuation-in-part of application No. 15/021,063, filed as application No. PCT/US2014/055353 on Sep. 12, 2014, now Pat. No. 10,292,478.

(60) Provisional application No. 61/877,123, filed on Sep. 12, 2013.

(51) Int. Cl.

| | |
|---|---|
| ***A45D 42/04*** | (2006.01) |
| ***A45D 33/00*** | (2006.01) |
| ***B65D 43/16*** | (2006.01) |
| ***B65D 53/02*** | (2006.01) |
| ***B65D 41/04*** | (2006.01) |
| ***A45D 40/22*** | (2006.01) |

(52) U.S. Cl.

CPC ..... *A45D 33/008* (2013.01); *A45D 40/221* (2013.01); *A45D 42/04* (2013.01); *B65D 41/04* (2013.01); *B65D 43/166* (2013.01); *B65D 53/02* (2013.01); *A45D 2040/225* (2013.01); *A45D 2200/051* (2013.01)

(58) Field of Classification Search

None

See application file for complete search history.

(56) References Cited

U.S. PATENT DOCUMENTS

| | | | | |
|---|---|---|---|---|
| 5,611,362 A * | 3/1997 | Duncan | A45C 15/04 | 132/305 |
| 6,923,335 B2 * | 8/2005 | Fujita | B65D 50/061 | 206/823 |
| 2013/0256329 A1 * | 10/2013 | Belfance | B65D 81/266 | 156/69 |

* cited by examiner

*Primary Examiner* — Mollie Impink

(74) *Attorney, Agent, or Firm* — IP Attorneys Group, LLC

(57) ABSTRACT

An airtight cosmetic compact, wherein the airtight feature is created by interaction between a seal on the inside of the cover and the upwardly facing recess of the base. The cover locks on the base by either thread elements on both cap and base or by bayonet like cams, allowing the cover to be twisted on the base compressing the cover against the base and engaging the seal with the base recess. By compressing the seal against the base and holding it in place through the threaded engagement the air-tightness of the compact is achieved and guaranteed.

20 Claims, 19 Drawing Sheets

AIRTIGHT COMPACT

CROSS-REFERENCE TO RELATED APPLICATION

This application is a continuation-in-part application of U.S. Non-Provisional patent application Ser. No. 15/021,063, filed Mar. 10, 2016 and titled "Airtight Compact," which is a national stage entry of International Application No. PCT/US2014/055353, filed Sep. 12, 2014 and titled "Airtight Compact," which claims priority to and the benefit of U.S. Provisional Patent Application No. 61/877,123, filed Sep. 12, 2013 and titled "Airtight Compact." The contents of the above-identified Applications are relied upon and incorporated herein by reference in their entirety.

TECHNICAL FIELD

The invention relates to cosmetic cases, particularly to compacts having airtight functions.

BACKGROUND OF THE INVENTION

Historically, cosmetic compacts have been small, flat cases for containing and transporting cosmetic face powder, a powder puff for applying the cosmetic, and a mirror. Typically, compacts were hand sized or smaller cases that could be easily carried in a purse or pocket. Many of these face powders were mineral powders such as talc, often containing mineral pigments. Such mineral powders are typically insensitive to air, containing no components that discolor, decompose, or degrade when exposed to air and containing no volatile materials that could evaporate and damage the consistency of the product. The compacts for such cosmetics were usually flat hinged boxes of various shapes including round, square, oval, or rectangle, consisting of a cover and a base, and had a simple clip holding them closed. While such containers sometimes had a thin paper or plastic seal to prevent the cosmetic from scattering during shipping, this seal was removed and discarded by the consumer before using the cosmetic.

Advances in cosmetic technology and evolutions in packaging have led to the packaging of other types of makeup including eye shadow, lip gloss, rouges, concealers, and new varieties of face powders in small flat containers, some with and some without the associated applicators, and with or without mirrors. All of these containers have been referred to widely as compacts, and many share the same hinged-box construction of the earlier compacts. For the purposes of this patent application, the terms compact and cosmetic case will be used interchangeably to refer to such containers for cosmetics, with or without associated applicators, and with or without a mirror.

Compacts have many advantages, such as being easy to open and use, convenient to carry, and easy to store and pack. Many of the new cosmetics now being stored and transported in such containers, however, are more sensitive to oxygen, humidity, or air than mineral powders, and cosmetics stored in such containers frequently degrade. Many useful pigments discolor or decompose when exposed to air, and carriers for such pigments frequently contain volatile or air sensitive components. The previous hinged box form compact is poorly suited for cosmetics containing volatile or air sensitive components. It is desirable, therefore, to provide a compact that retains the advantages of ease of opening and use, convenience of carrying, and ease of storage and packing, while also maintaining a reusable airtight seal to preserve the cosmetics before and between uses.

Several attempts have been made to provide an airtight function on a compact, typically by adding additional cover elements inside the compact. In general, providing an airtight function to a container requires either machining the base and the cover of the container from rigid materials to such close tolerances that the fit between the rigid materials leaves no air gaps, or utilizing flexible or elastomeric materials as seals which can be deformed under pressure to fill any openings between the base and the cover. In some designs, a separate inside container is provided, consisting of a cover and a base containing the cosmetic, the inside container fitting into the base of the compact and providing an airtight seal around the cosmetic. In use, the consumer must open first the cover of the compact and then the cover of the inside container to access the cosmetic, and close first the container cover and then the compact cover to store. To maintain the seal on the inside container, the compact lid is provided with either a thread or bayonet-like cam design which locks onto the compact base and applies pressure to the cover of the inside container.

On other airtight compacts, the airtight function is achieved by providing an internal smaller cover that interacts with the base of the compact. In some examples, a flat gasket is pressed between the internal cover and the base to provide an airtight seal. Other examples provide a peripheral gasket such as an O-ring that interacts with a matching element on the base. Still other examples act by pressing a lip molded underneath the internal cover against the base. Similar to examples having a separate inside container, the internal cover is kept in place by the compact cover pressing down on the inside lid and locking on the base by either a thread or a bayonet like cam design. Like compacts with a separate inside container, compacts with internal covers require opening both the compact cover and an interior cover before the cosmetic container can be accessed, and closure of both an interior cover and the compact cover are required for airtight storage.

In addition to the issues with airtight compact cases discussed above, for compacts which contain threads on the cover it can additionally be difficult to determine when the lid is fully secured, giving rise to the possibility that liquid contents may leak out or air sensitive contents may spoil. Alternatively, if the cover cannot be secured in the open position, it can potentially be lost if not attached to the case by any means or prematurely close when using the case.

SUMMARY OF THE INVENTION

It is thus an object of this invention to provide an effective airtight function on a compact by using just two elements, namely the compact cover assembly and the compact base, without the need for any additional element to guarantee the airtight function. It is a further object of this invention to provide an airtight compact with only a single cover that need be opened to access the cosmetic. It is a further object of this invention to provide an airtight compact that can be molded out of as few as two molded plastic parts, a cover assembly and a base, although embodiments with three or more molded parts including a cover, a base, and an intermediate ring are also envisioned. Additional elements or internal parts such as a threaded screw and an elevator are also envisioned. It is a further object of this invention to provide an airtight compact case which has a cover assembly which can be secured in a given position.

In some embodiments, the intermediate ring does not form part of the airtight portion of the compact, but by being hinged with the cover and by being assembled with the base, forms a cover assembly that allows the cover to be hinged on the base and allows a degree of rotation between the cover and base permitting the sealing of the cover to the base.

In some embodiments, the base has a center upwardly facing recess forming a receptacle for a cosmetic product, the top open end of the recess engaging the cover to form an airtight seal.

The cover in some embodiments includes a sealing element, which in some embodiments is a semi-flexible valve seal ring protruding off of the inside face of the cover.

In some embodiments, when the cover is closed over the base and tightened, the valve seal ring of the cover engages and wedges itself into the upwardly open end of the base recess creating an effective and efficient airtight chamber between the cover and base. In some embodiments, the cover is tightened onto the base utilizing, eg. threads on the cover which engage matching threads on the base; a bayonet mount comprising pins on the cover which engage slots on the base or pins on the base which engage slots on the cover; springs or spring clips biased to press the cover onto the base; or any other means known in the art.

In other embodiments, pressure to engage the airtight function can be applied by manually pressing the cover onto the base, and the pressure maintained by use of a fastener or a plurality of fasteners to hold the cover to the base. In some embodiments, such fasteners are rigid in nature and include catches, hooks, or interlocking clips. In other embodiments, the fastener is more flexible, and includes interlocking hook and loop fasteners between surfaces affixed to the cover and base or on a strap or straps affixed to the cover and base. In still other embodiments, spring clips, elastic bands, string ties, or straps with snaps or D-rings are used to maintain the pressure between the cover and the base and thus the airtight function of the compact.

In one embodiment of the invention, the compact consists of five pieces: a cover, a ring, a base, a screw piece, and an elevator. In some embodiments, rotation of the ring causes the elevator and screw piece to engage which pushes the elevator up or down in a vertical direction.

In some embodiments the cover swings back on a pin fitted into a hinge between the cover and the intermediate ring. The cover also tightens onto the base by rotating it through matching threads between the cover downward face and the base upward face. The inside face of the cover has a downwardly facing protruding ring here called the valve seal ring that by engaging and wedging itself into the upwardly facing open end of the base recess creates the airtight product chamber. The intermediate ring, which is hinged to the cover using the hinge pin, is assembled to and retained on the base in a way that allows the now rotationally solid cover assembly to be rotated in relation to and on the base.

In some embodiments, the ring is retained on the base by protrusions extending from the inside of the ring to engage a groove in the wall of the recess. In other embodiments, the ring is retained by a shoulder extended inward from the ring to engage a groove on the wall of the recess. In further embodiments, the ring is retained by protrusions extending from the recess wall to engage a groove on the inner wall of the ring. In some embodiments the groove is provided with one or more risers to lift the ring slightly as the cover is unscrewed, advantageously preventing the ring from jamming on the recess wall. In some embodiments, the ring is retained to the screw piece by the methods discussed above. In some embodiments the ring and base projection interact to lock the cover assembly in a certain position.

In some embodiments, a mirror is assembled to the compact.

In some embodiments, the hinge is provided by a projection extended downward from the cover into an aperture formed in the intermediate ring. A pin extending through the protrusion and into the sides of the aperture on the intermediate ring acts as a hinge pin. The outer profile of the protrusion is shaped to match the outer profile of the intermediate ring. The internal hinge provided by such an arrangement allows the provision of a compact cosmetic case with a smooth outer profile having no external hinge protrusions which can get caught in the cloth of a pocket or pocketbook.

In some embodiments the intermediate ring is made and molded as part of the cover, attached to the cover by means of a thin diaphragm of flexible material. This thin diaphragm becomes a flexible connecting element, frequently referred to in the art as a living hinge. In some embodiments, an aperture is provided in the intermediate ring for the living hinge to fit into when the cover is closed, allowing the outer surface of the living hinge and the outer diameter of the intermediate ring to form a smooth profile.

This one-piece ring/cover configuration retains and allows all the functions and features as the cover assembly formed from two separate parts previously described, and is advantageous for inexpensive airtight packages such as promotional compacts.

In some embodiments, the cosmetic case further comprises a chamber in vapor contact with the product receptacle. In one embodiment, the chamber is separated from the product receptacle by a perforated disc. In another embodiment, the chamber is separated from the product receptacle by a semi-permeable membrane. This chamber contains a substance intended to further preserve the properties of the product and in exemplary embodiments is selected from a list consisting of a preservative, a bactericide, a biocide, a water source, a solvent, a desiccant, and combinations thereof.

This invention provides an effective and efficient airtight compact with the smallest possible dimensions both horizontally and vertically.

This invention provides an effective and efficient airtight compact with no other parts or elements involved in obtaining the airtight feature.

This invention provides a case whose cover assembly can be secured in a certain position.

This invention provides a very effective airtight compact while reducing the cost to manufacture it and the consequent cost of goods.

DETAILED DESCRIPTION

Figure 1:
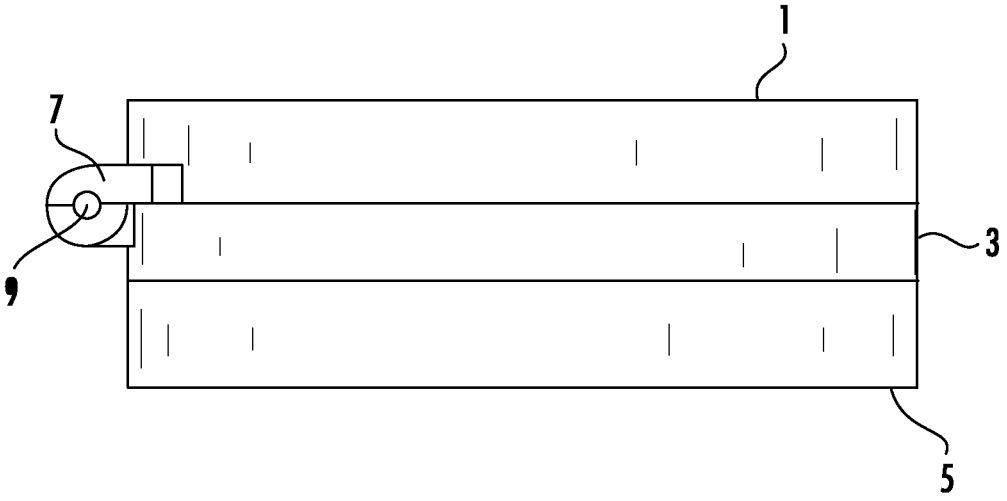
FIGS. 1 and 2 depict side views of embodiments of an airtight compact in accordance with the invention.

The invention relates to airtight compacts or cosmetic cases, which for the purposes of this patent will be used interchangeably to refer to small, portable containers for cosmetics with or without hinged covers, and with or without affixed mirrors. In particular, the invention relates to airtight compacts in which only a single cover is opened to expose the cosmetic for use. In these compacts, a cosmetic product is stored in a recess (13) comprising a base (5) and a cover (1). When the cover is closed, an airtight seal is formed between the cover and the base. In some embodiments, the recess is sized to fit a standard size cosmetic pan (41), advantageously permitting use of the cosmetic case for a variety of colors and compositions of cosmetics. In some embodiments, the recess is sized to contain an industry standard cosmetic pan. In some embodiments the recess is sized to fit longer and narrower objects, such as foundation sticks, lip sticks, or lip balm.

In some embodiments the recess (13) is defined by a recess wall (17) extending upwardly from an upper surface (6) of the base (5) having an upwardly facing open end defined by a lip (19). In some embodiments cover 1 has a downwardly facing seal (14) configured to engage the lip of the recess to form an airtight container for the cosmetic product. In some embodiments, the seal is a flexible or elastomeric material affixed to the cover. Pressure holding the cover to the base provides force to deform the flexible or elastomeric material sufficiently to provide an airtight function between the cover and the lip of the recess. In other embodiments, the cover is made of a flexible or elastomeric material and deforms sufficiently to provide an airtight function without providing an additional seal.

Figure 17:
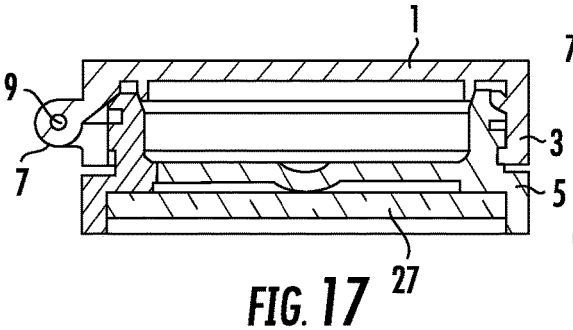
FIGS. 17 and 18 depict sectional views of the compacts shown in FIGS. 1 and 2 with covers closed and seal open.
Figure 18:
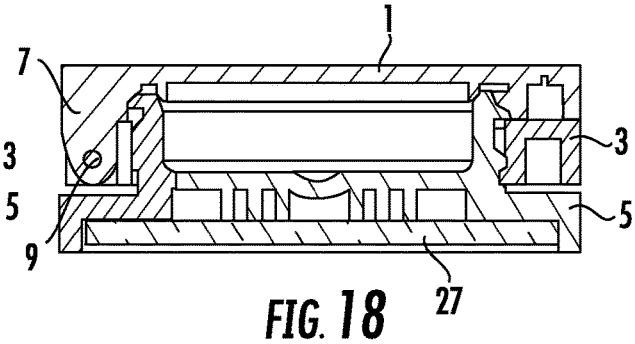
Figure 19:
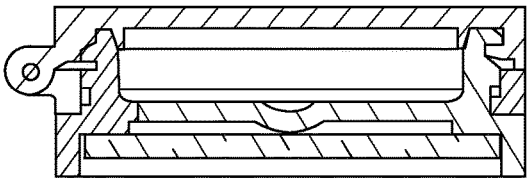
FIGS. 19 and 20 depict sectional views of the compacts shown in FIGS. 1 and 2 with covers closed and seals formed.
Figure 20:
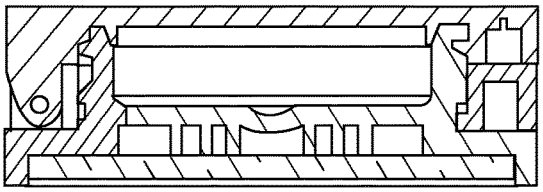
Figure 21:
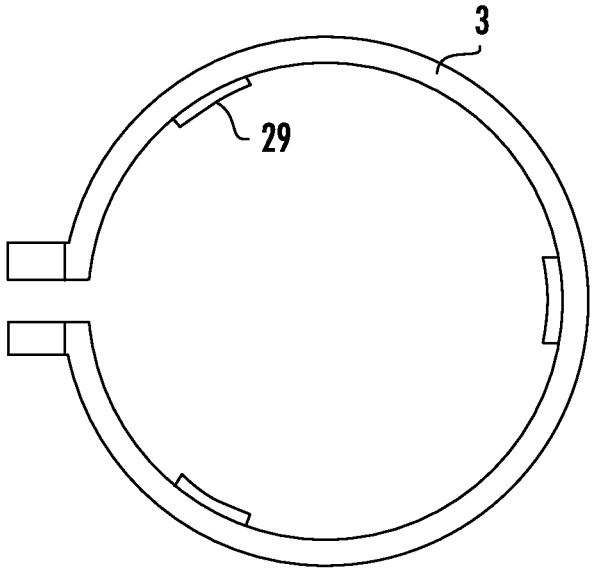
FIGS. 21, 22, and 36 depict top views of the intermediate ring of the embodiments of the invention shown in FIGS. 1 and 2.
Figure 22:
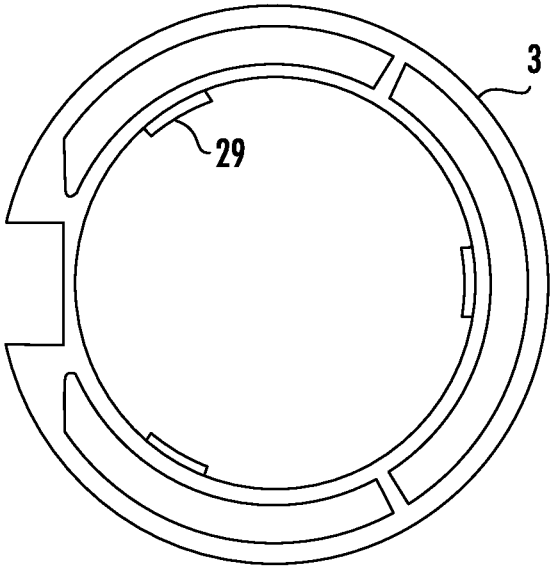
Figure 23:
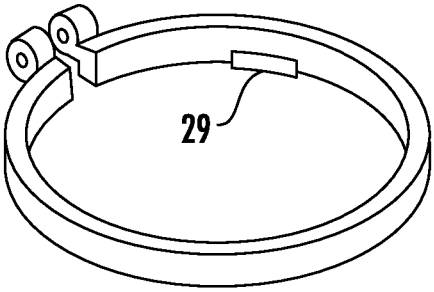
FIGS. 23 and 24 depict upper perspective views of the intermediate ring of the embodiments of the invention shown in FIGS. 1 and 2.
Figure 24:
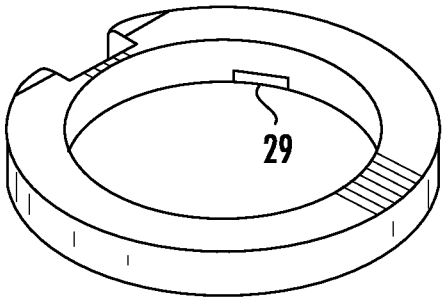
Figure 25:
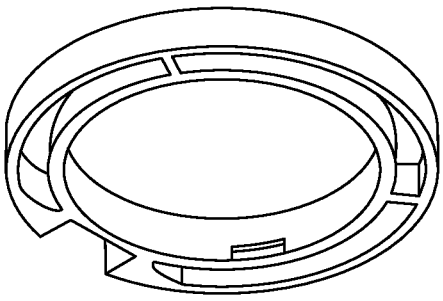
FIG. 25 depicts a lower perspective view of the intermediate ring of the embodiment of the invention shown in FIG. 2.
Figure 26:
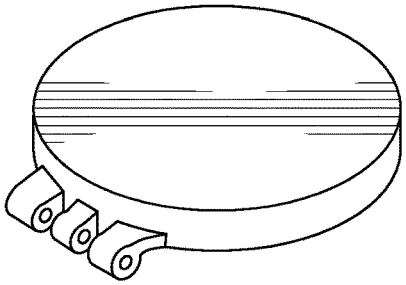
FIGS. 26 and 30 depict upper perspective views of the cover of the embodiments of the invention shown in FIGS. 1 and 2.
Figure 27:
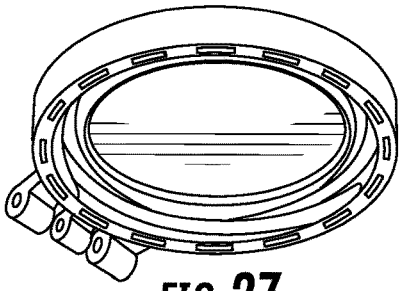
FIGS. 27 and 31 depict lower perspective views of the cover of the embodiments of the invention shown in FIGS. 1 and 2.
Figure 28:
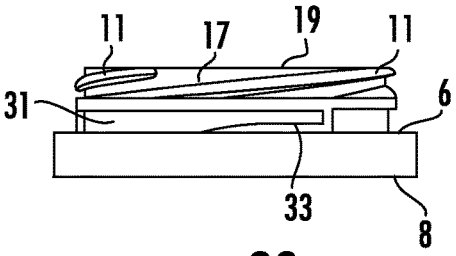
FIGS. 28, 32, and 39 depict side views of the base of the embodiments of the invention shown in FIGS. 1 and 2.
Figure 29:
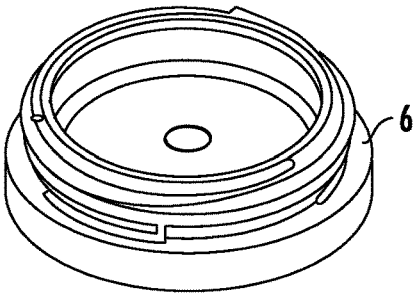
FIGS. 29 and 33 depict upper perspective views of the embodiments of the invention shown in FIGS. 1 and 2.
Figure 30:
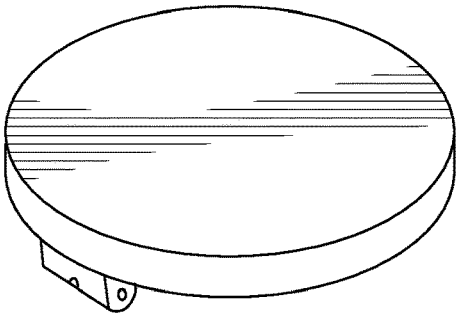
Figure 31:
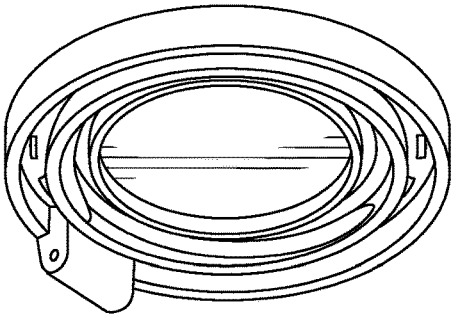
Figure 32:
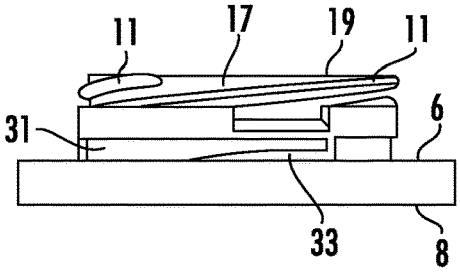
Figure 33:
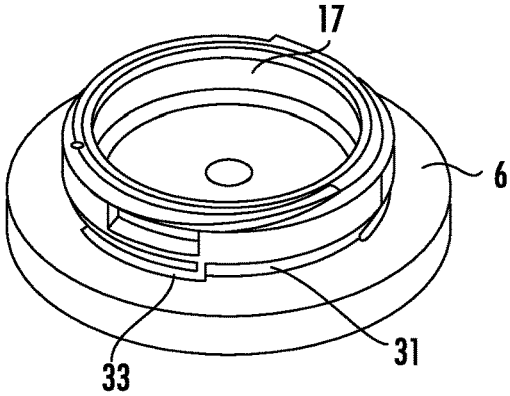

In some embodiments, the seal is a valve seal ring. This is a ring of flexible or elastomeric material extending off of the cover and configured to engage the lip (19) of the recess. In some embodiments, as shown in FIGS. 17 and 18, the external periphery (25) of the valve ring seal engages the internal periphery (23) of the lip of the recess to form an airtight seal when the cover is held down to the base. In other embodiments, the internal periphery of the valve ring seal engages the external periphery of the lip of the recess. In still other embodiments, the bottom surface of the valve ring seal engages the top surface of the lip of the recess. In further embodiments, the valve ring seal is slotted to engage both the internal and external periphery of the lip of the recess.

In many embodiments using a valve seal ring, the engaging surfaces of the valve seal ring and the lip of the recess are chamfered slightly in opposite directions (63). In an embodiment in which the external periphery of the valve ring seal engages the internal periphery of the lip of the recess, the external periphery of the valve ring seal tapers slightly from larger at its upward extent to smaller at its downward extent. Conversely, the internal periphery of the lip of the recess is tapered slightly from smaller at its upward extent to larger as it approaches the base, as shown by 63 in FIGS. 35 and 46. This has the advantageous effect of compressing the valve seal ring as it is pressed into the lip of the recess, improving the airtight function of the container. The chamfers provide slight differences in the terminal diameters of the engaging surfaces which allow a more positive seating of the valve seal ring to the lip of the recess due to the size difference of the terminal diameters of the engaging surfaces as the cover is closed, and the resulting sloped surfaces allow more of the pressure holding the cover to the base to be applied directly to the engaging surfaces.

In some embodiments, the seal is a disc of flexible or elastomeric material affixed to the cover on one surface and configured to engage the top surface of the lip of the recess on the other surface. In some embodiments, the disc is flat, providing advantages in ease of construction. In other embodiments, the disc is convex, the center extending further from the cover than the periphery, providing more positive centering and sealing to an interior periphery of the lip of the recess. In still other embodiments, the seal is concave, the periphery extending further from the cover than the center, providing an enlarged storage space inside the airtight chamber and being less likely to disturb and ornamental upper surface on the product in the receptacle.

In other embodiments, the seal is an annular gasket affixed to the cover.

In some embodiments, a seal is provided on the base, configured to engage a corresponding surface on the cover. In one embodiment, the lip of the recess comprises a flexible or elastomeric material which forms an airtight function when pressed against the cover. In other embodiments, the cover further comprises a downwardly protruding feature configured to engage the flexible portion of the lip to provide the airtight function. In one embodiment, the downwardly protruding feature is a ridge configured to engage one or more of the internal periphery, the external periphery, or the surface of the lip of the recess. In another embodiment, the downwardly protruding feature is a disc with an external periphery configured to engage the internal periphery of the lip of the recess. In different embodiments, the disc is flat, convex, or concave. In some embodiments, the engaging surfaces of the lip of the recess and the downwardly protruding feature of the cover are chamfered slightly in opposite directions, advantageously improving the airtight function of the container.

Figure 2:
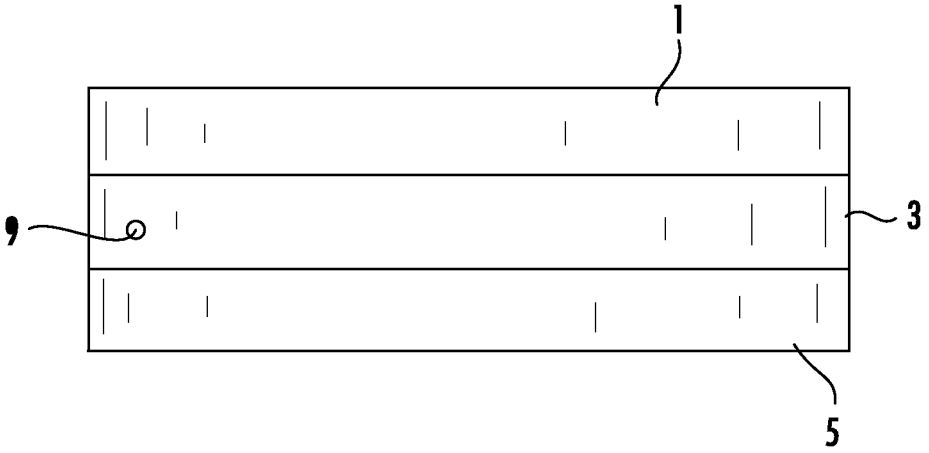
Figure 3:
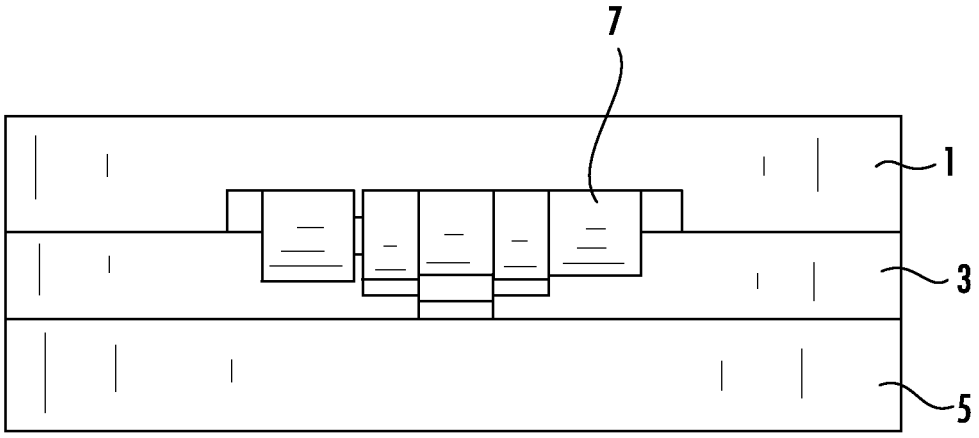
FIGS. 3 and 4 depict rear views of the compacts shown in FIGS. 1 and 2.
Figure 4:
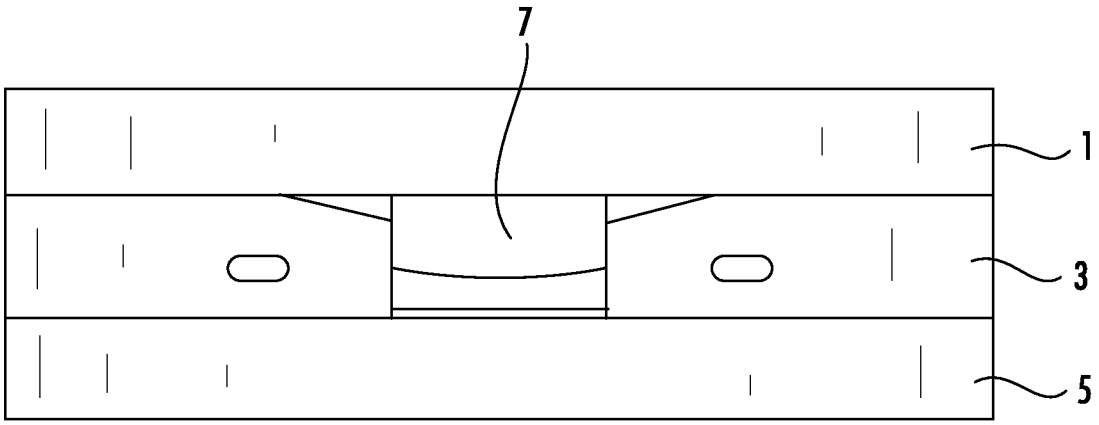
Figure 5:
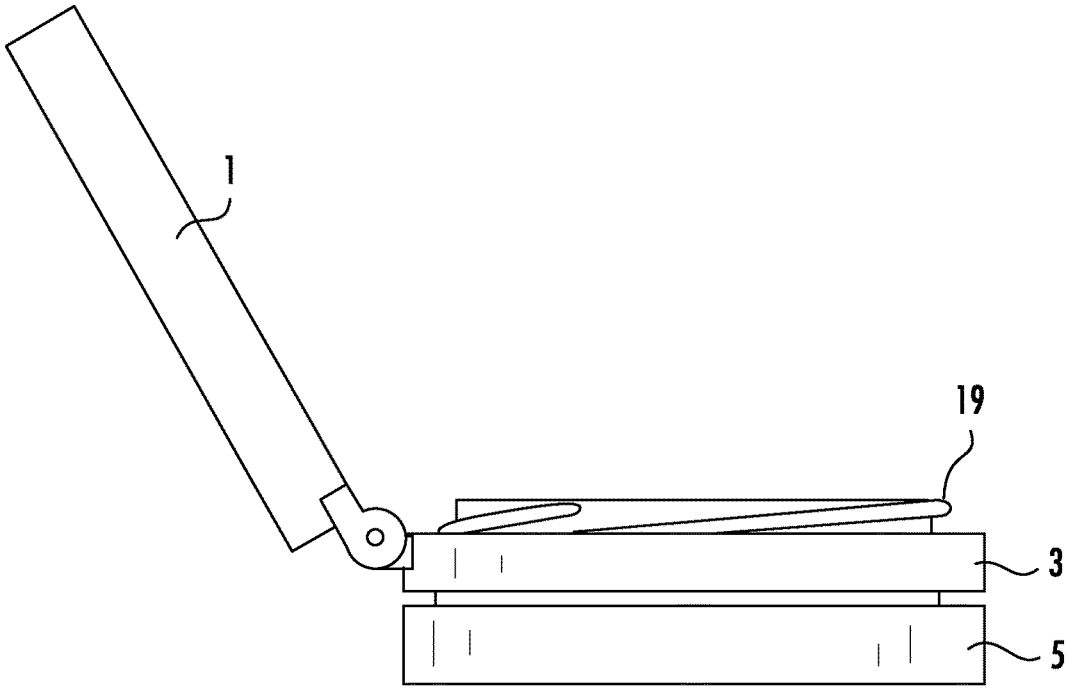
FIGS. 5 and 6 depict side views of the compacts shown in FIGS. 1 and 2 with the covers opened.
Figure 6:
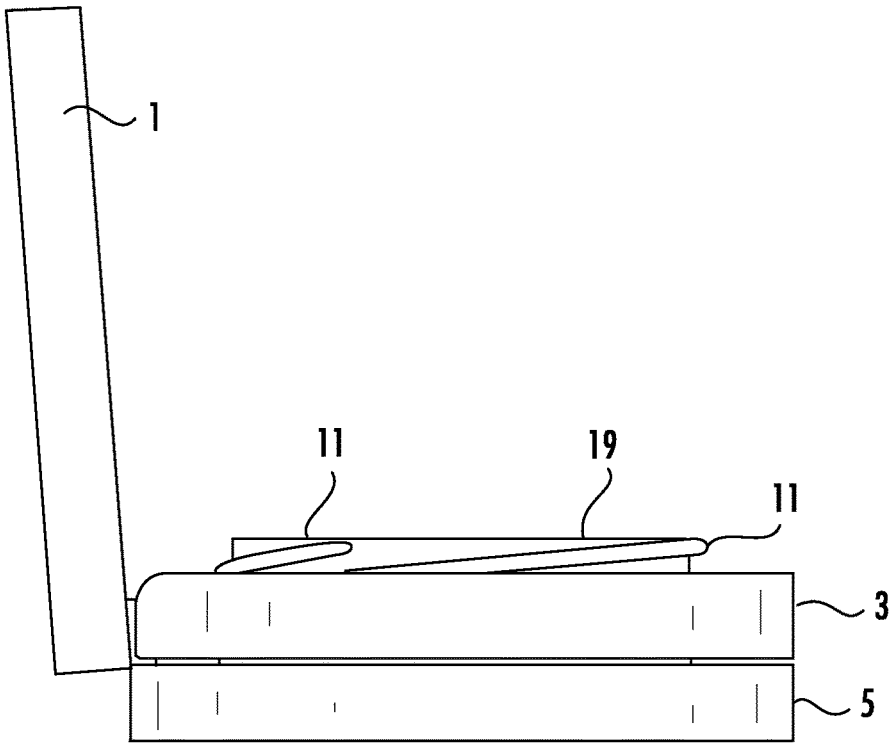
Figure 7:
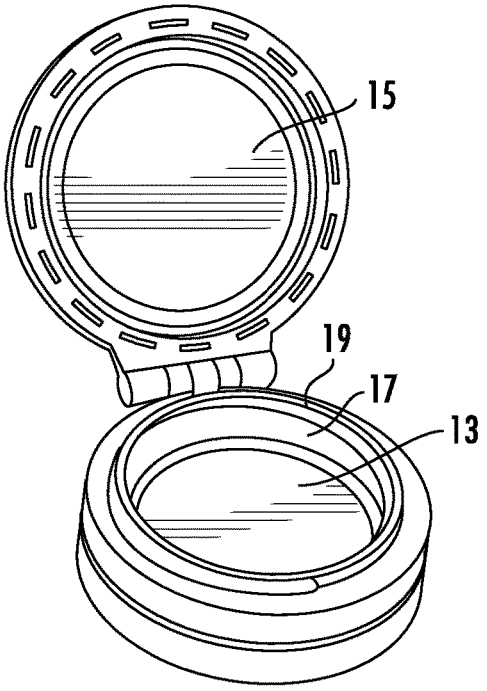
FIGS. 7 and 8 depict perspective views of the compacts shown in FIGS. 1 and 2 with the covers opened.
Figure 8:
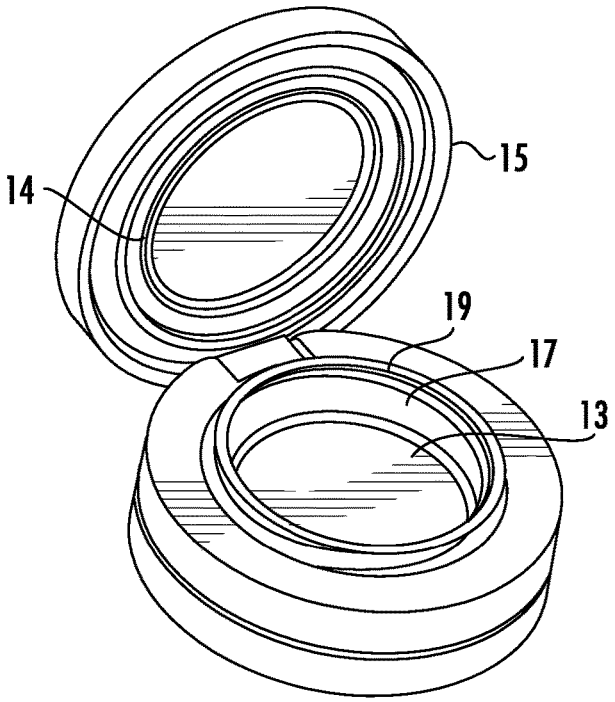
Figure 9:
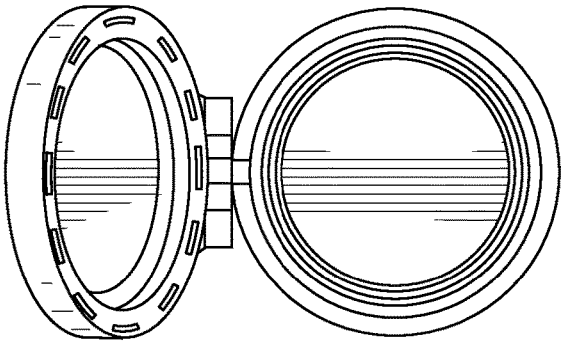
FIGS. 9 and 10 depict top views of the compacts shown in FIGS. 1 and 2 with the covers opened.
Figure 10:
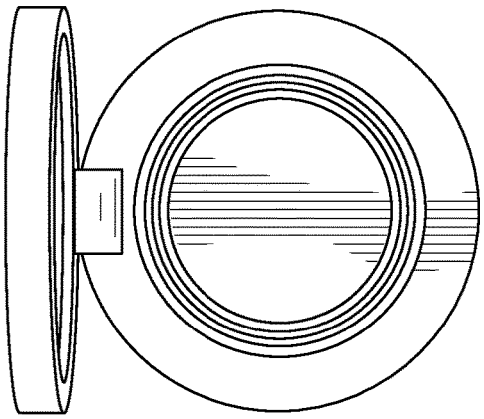
Figure 11:
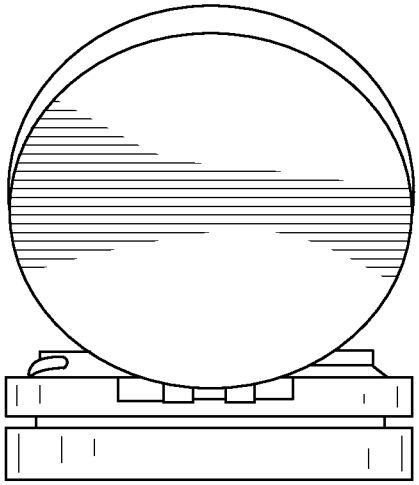
FIGS. 11 and 12 depict rear views of the compacts shown in FIGS. 1 and 2 with the covers opened.
Figure 12:
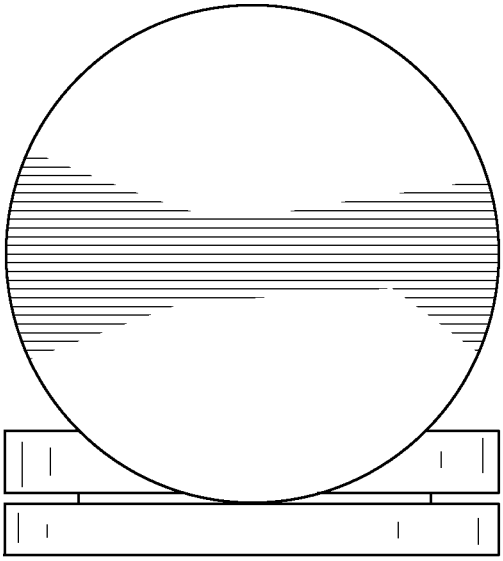
Figure 13:
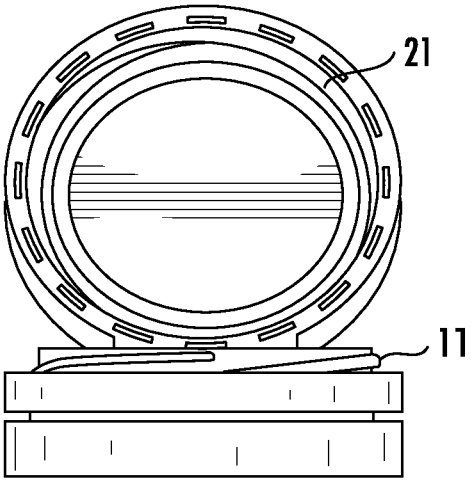
FIGS. 13 and 14 depict front views of the compacts shown in FIGS. 1 and 2 with the covers opened.
Figure 14:
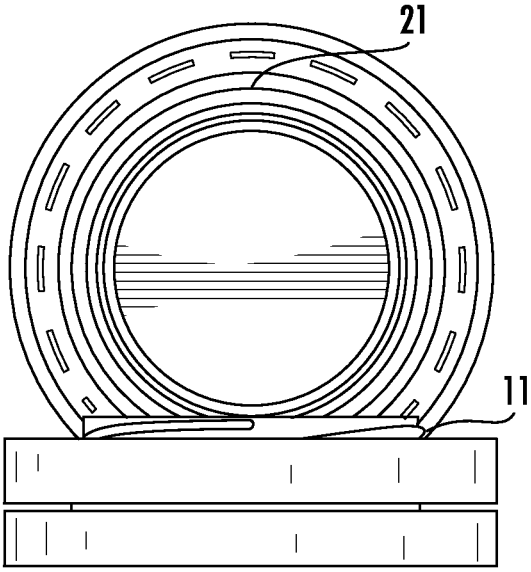
Figure 15:
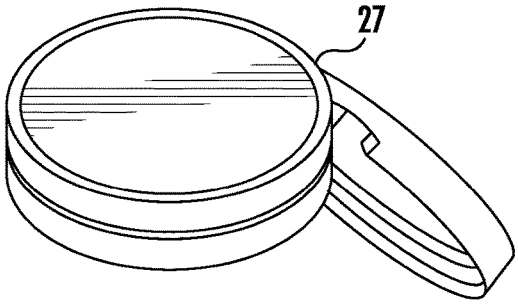
FIGS. 15 and 16 depict bottom perspective views of the compacts shown in FIGS. 1 and 2 with the covers opened.
Figure 16:
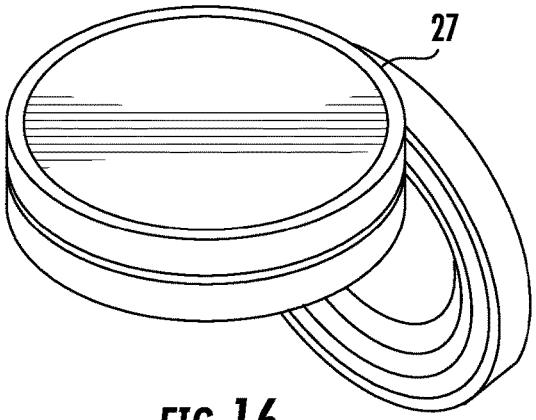

FIGS. 1 and 2 illustrate two embodiments of the airtight compact of the current invention. In FIG. 1, the hinge is external to the diameter of the compact. In FIG. 2, the hinge is contained within the external diameter of the compact. These embodiments comprise a cover (1), an intermediate ring (3) and a base (5). They further comprise a hinge (7) of two parts molded into the cover and the intermediate ring, and a hinge pin (9) to maintain the hinged relationship between the cover and the intermediate ring. As can be seen from FIGS. 7-8, the base contains a recess (13) formed from a wall (17) extending upwardly from the base. As shown in FIGS. 21-25, 28-33, and 36-39 the intermediate ring (3) is fixed to the cover by protrusions (29) extending inwardly from the inner surface of the intermediate ring, the protrusions fitting into matching grooves (31) in the wall. This allows the intermediate cover to rotate with respect to the base about the external diameter of the wall, while preventing the ring from being detached from the base. The upward extent of the wall forms a lip (19) defining the opening of the recess.

In some embodiments, the grooves are defined by an upper and lower edge, each parallel to the upper surface of the base, the groove being wider than the thickness of the protrusions. This allows the ring to move axially with respect to the base within the groove, the protrusions free to move perpendicular to the groove to an extent limited by the edges of the groove. This limited freedom of axial movement aids in engaging the threads on the cover and base and eases the requirement for machining to tight tolerances. Because the cover is attached to the ring by a hinge, a slight opening of the hinge permits the threads to engage even if there is some variation between manufactured parts.

In some embodiments, a riser (33) is provided at the terminus of the groove. This advantageously lifts the ring away from the surface of the base at the extent of the ring's rotation, preventing any separation of the cover from the ring during rotation from wedging the ring against the recess wall as the cover is unscrewed. In one embodiment, the riser is a portion of the lower edge of the groove that slopes upward in relation to the upper surface of the base. In some embodiments riser 33 is provided on base 5 without a corresponding groove on the base.

FIGS. 21-22 and 36-39 show different embodiments of ring protrusions 29. In some embodiments ring protrusion 29 is made up of just ledge 44. In some embodiments ring protrusion 29 is made up of bump 42, gap 43 and ledge 44. In some embodiments the bump, gap, and ledge are placed in the listed order clockwise and in other embodiments the order is reversed, having the ledge, then gap then bump in clockwise order. This bump, gap, ledge motif interacts with base protrusion 49 to secure the cover assembly in a certain position, depending on the location of the protrusions. In some embodiments ring protrusion 29 is a ledge 44 and hook 45 which also interacts with base protrusion 49 to secure the cover assembly in a certain position. In some embodiments the ledge is followed by the hook in clockwise order, and in other embodiments the hook precedes the ledge in clockwise order. In some embodiments ledge 44 is approximately the size shown in FIG. 36, while in other embodiments ledge 44 is smaller than depicted in FIG. 36 and in other embodiments ledge 44 is larger than depicted in FIG. 36. In some embodiments ledge 44 is less than 0.5 centimeters, in some embodiments ledge 44 is 0.5-1 cm, and in other embodiments ledge 44 is 1-2 cm. The different sizes of ledge 44 are required for different functions. If ledge 44 us being used to guide ring 3 through groove 31 and riser 33 a larger ledge 44 is required. However, if ledge 44 is being used simply as a locking or movement halting piece, the smaller embodiments of ledge 44 are adequate. In this way the minimum amount of material is used to effect the desired function of ledge 44. In some embodiments, the cover assembly is secured in an open position. This embodiment is useful for ensuring the cover does not rotate and interfere with the use of the contents of the compact case. In other embodiments the cover assembly is secured in a closed position. This embodiment is useful for determining when the cover assembly is in the fully closed position as a means of avoiding content leakage or spoilage, and also aids in securing the cover assembly in said closed position. In yet other embodiments, the cover assembly is secured in an intermediary position.

Figure 39:
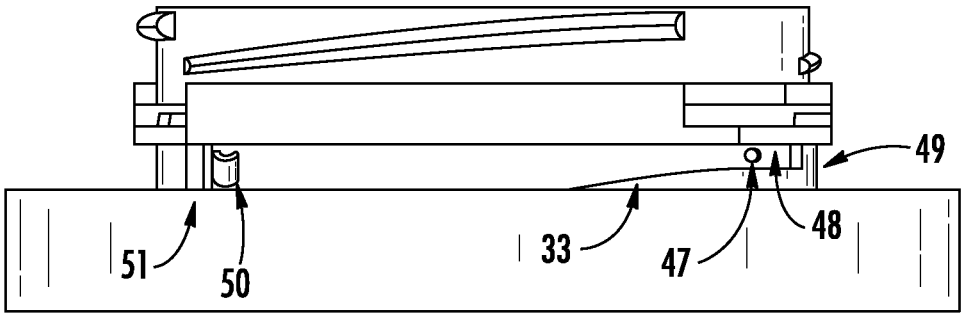
Figure 40:
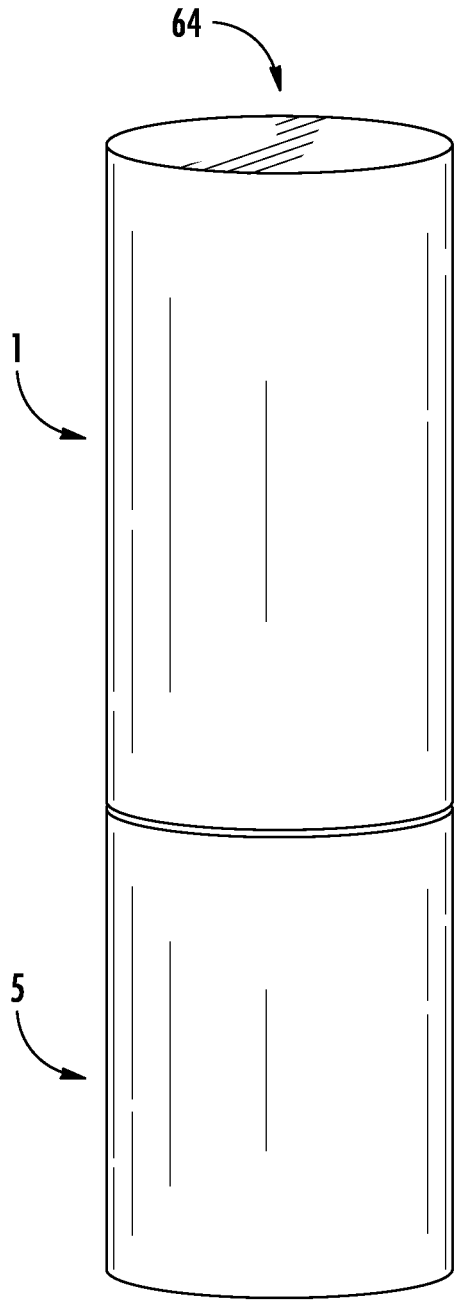
FIG. 40 depicts a side view of another embodiment of the invention shown in FIG. 1, where the compact case in the closed position.
Figure 41:
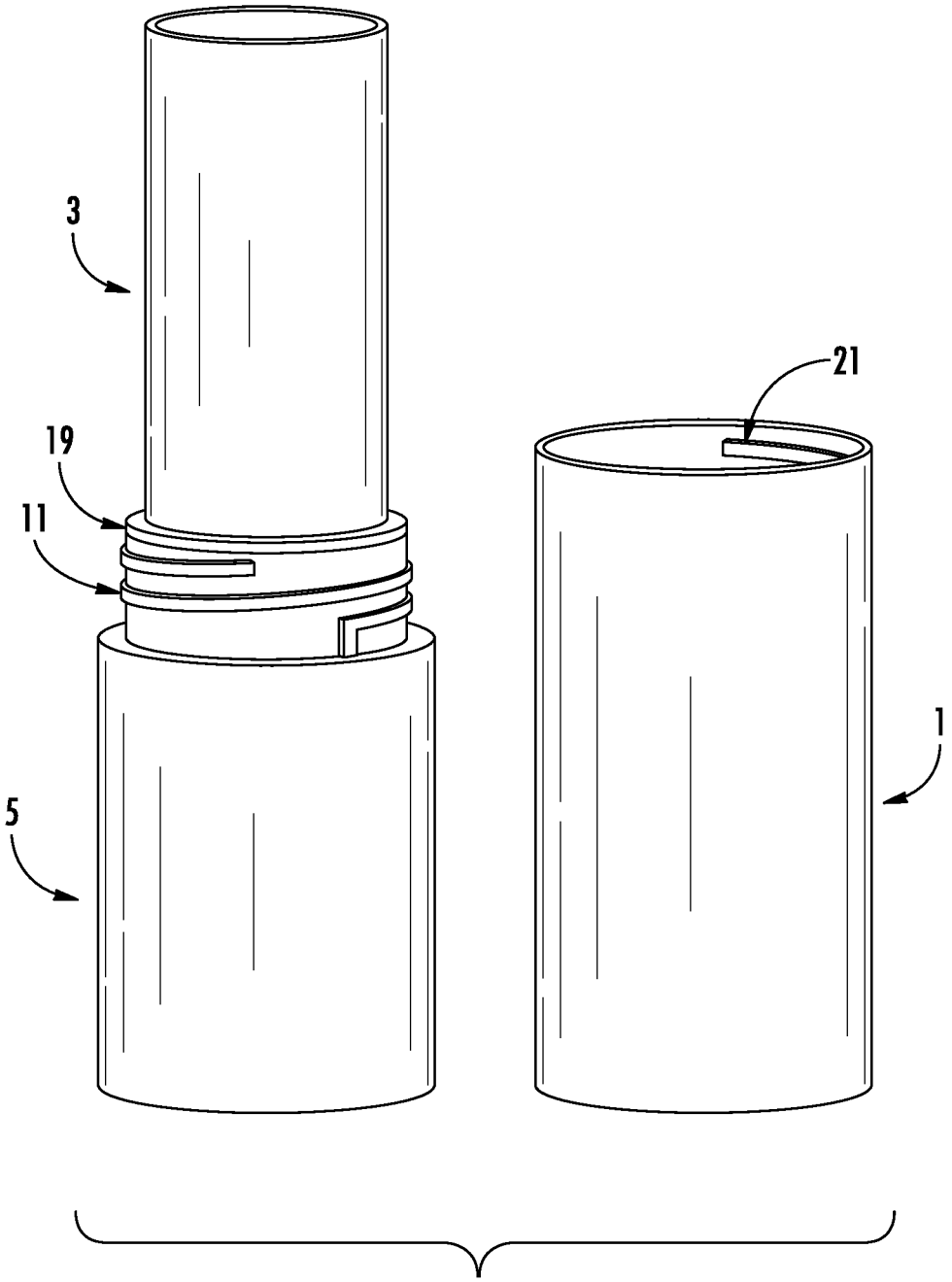
FIG. 41 depicts a side view of another embodiment of the invention shown in FIG. 1, where the compact case in the open position.
Figure 42:
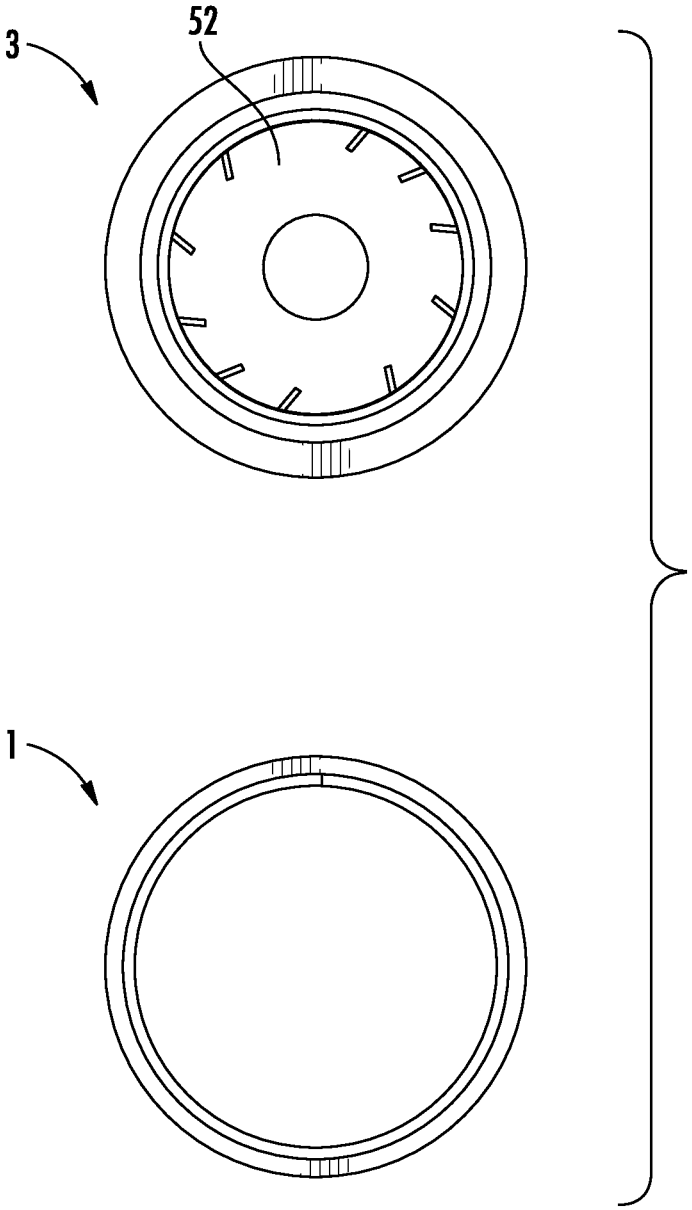
FIG. 42 depicts a top view of another embodiment of the invention shown in FIG. 1, where the compact case in the opened position.

As seen in FIG. 39, in some embodiments, the bump, gap, and ledge motif is located on the base, as seen with bump 47, gap 48 and ledge 49. This motif interacts with protrusion 46 on the ring to secure the cover assembly in a certain position, depending on the location of the protrusions. As discussed above, in some embodiments the order of the bump, gap, and projection is reversed from what is depicted in FIG. 39. In other embodiments, the hook 50 and ledge 51 motif is located on the base. As discussed above, in some embodiments the order of the hook and projection is reversed from what is depicted in FIG. 39. In some embodiments, the cover assembly is secured in an open position. This embodiment is useful for ensuring the cover does not rotate and interfere with the use of the contents of the compact case. In other embodiments the cover assembly is secured in a closed position. This embodiment is useful for determining when the cover assembly is in the fully closed position as a means of avoiding content leakage or spoilage, and also aids in securing the cover assembly in said closed position. In yet other embodiments, the cover assembly is secured in an intermediary position.

Figure 43:
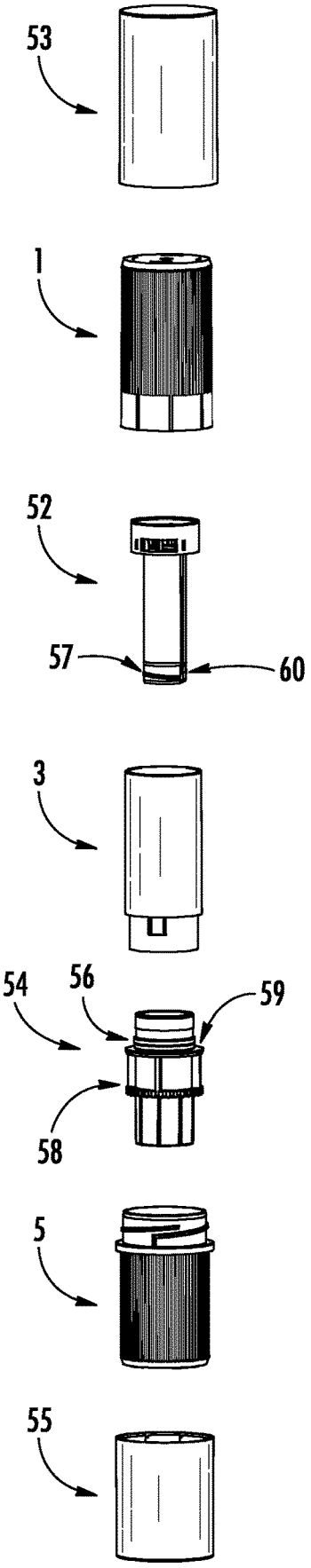
FIG. 43 depicts an exploded view of another embodiment of the invention shown in FIG. 1.
Figure 44:
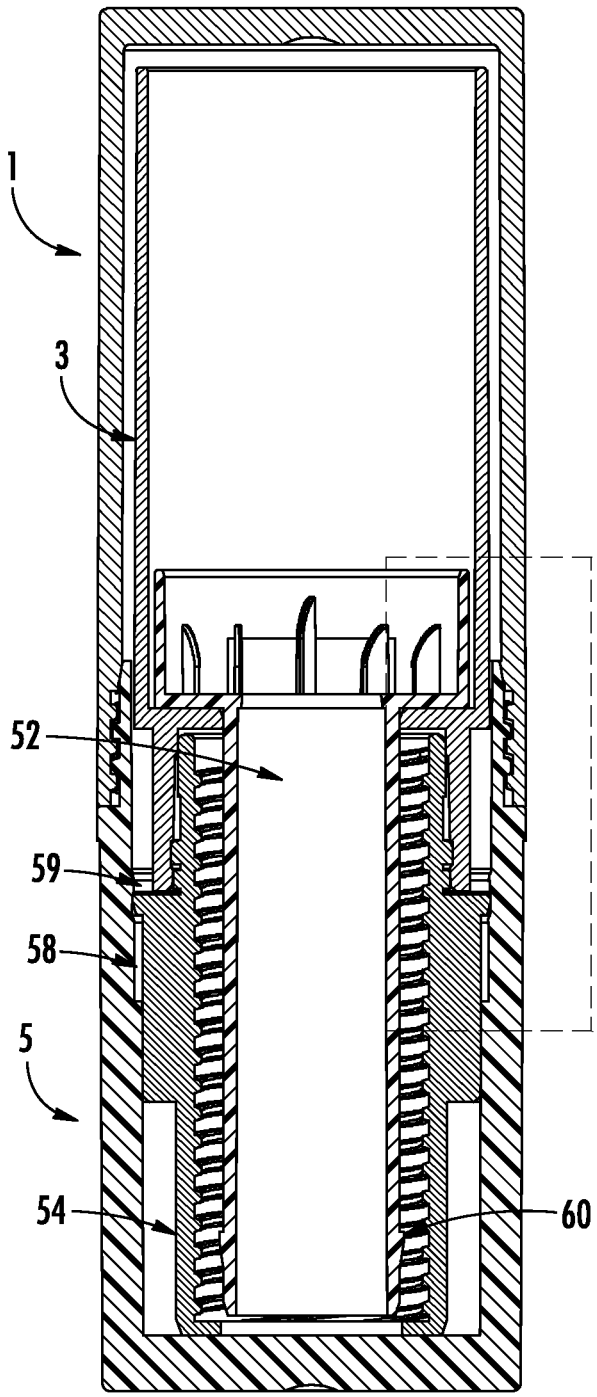
FIG. 44 depicts a cross-sectional side view of another embodiment of the invention shown in FIG. 1, where the compact case in the closed position.
Figure 45:
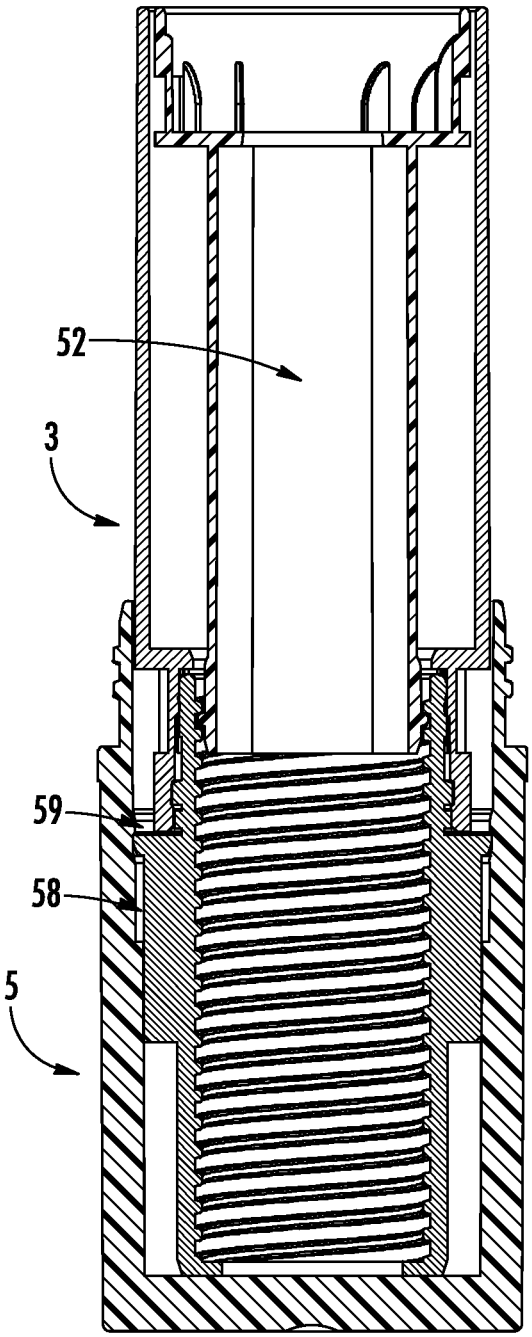
FIG. 45 depicts a cross-sectional side view of another embodiment of the invention shown in FIG. 1, where the compact case in the open position.

FIGS. 40-46 illustrate other embodiments of this invention, where ring 3 is located inside of cover 1 when closed. This can be seen comparing FIG. 40, which shows the closed structure of one embodiment of this invention, and FIG. 41 which shows the opened structure of the same embodiment. In some embodiments, an internal screw piece (54) and elevator (52) are contained within recess 13, as seen in exploded FIG. 43. FIGS. 44 and 45 show an embodiment where base 5 contains screw piece 54, and ring 3 sits on the top (59) of the ring (58) on screw piece 54. In some embodiments, elevator 52 is contained within ring 3 and projects through the bottom of ring 3 into screw piece 54. In some embodiments cover 1 fully covers ring 3.

In some embodiments, elevator 52 has threads (57) which match the threads (56) on screw piece 54. In this embodiment, as ring 3 is rotated with respect to base 5 (or as base 5 is rotated with respect to ring 3), the matching threads 56 and 57 engage and push elevator 52 up or down, depending on the direction of the rotation. In this embodiment ring 3 does not move in a vertical direction. These, and other similar embodiments, are useful for only allowing a small portion of the contents of the container to be exposed to air at a given time. As only the portion of the contents which are above ring 3 are exposed to air on all sides, this allows the contents to last longer than if significantly more surface area was exposed to air each time the case was opened. In some embodiments, threads are located on the inside of ring 3. In some embodiments, both ring 3 and elevator 52 have threads and move in a vertical direction when rotated with respect to base 5. In some embodiments only ring 3 and not elevator 52 moves in a vertical direction when rotated with respect to base 5. In other embodiments ring 3 moves in a vertical direction and no elevator is provided as a means of reducing the amount of components in the device.

Figure 46:
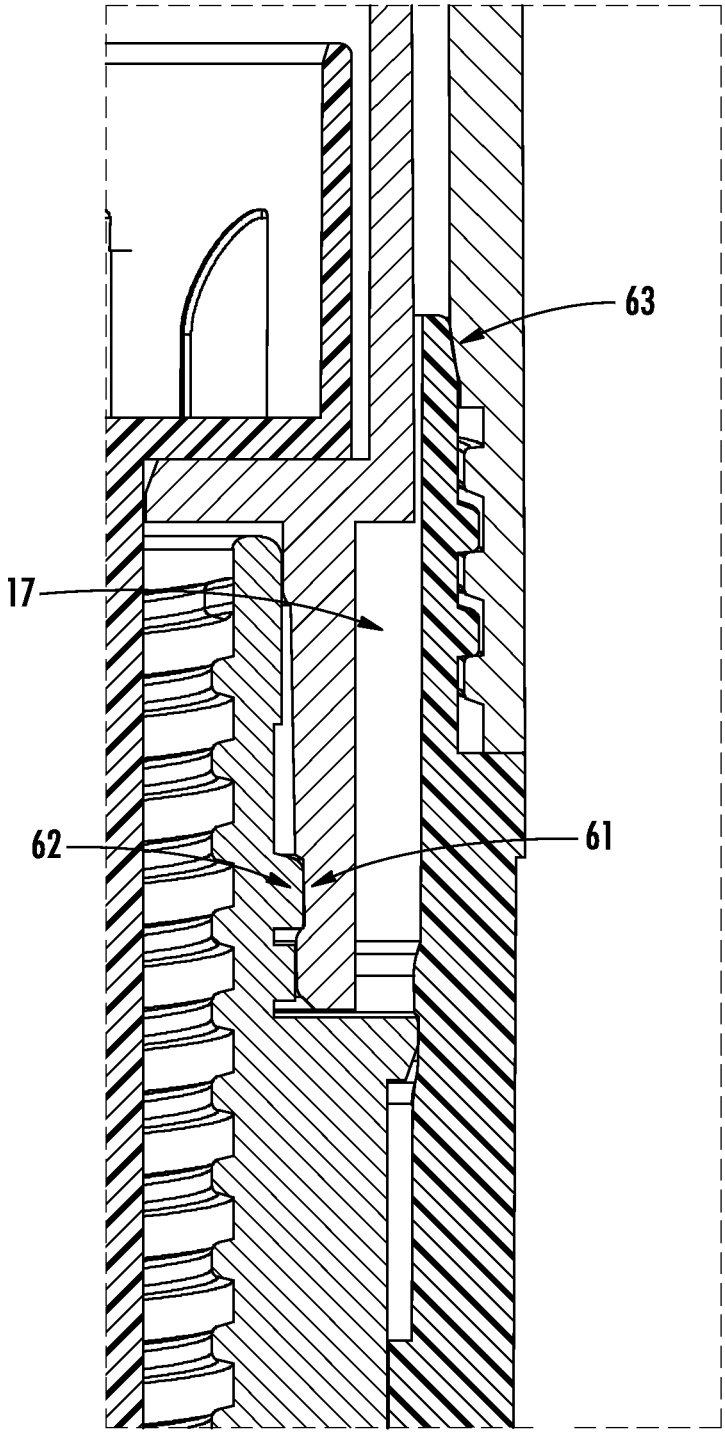
FIG. 46 depicts a zoomed in cross-sectional view of the sealing mechanism of another embodiment of the invention shown in FIG. 1, where the compact case in the closed position.

In some embodiments, the bottom of elevator 52 is kept from rising above the bottom of ring 3 by projection 60. As seen in FIG. 46, in some embodiments, ring 3 is substantially restrained from moving in the vertical direction by groove 61 on ring 3 and shoulder 62 on screw piece 54. In some embodiments, two rings are present, one that makes up the cover assembly, as in FIG. 1, and one that is engaged in the screwing mechanism discussed in the preceding paragraph. This embodiment is useful as it combines the benefits of having a cover assembly fixed to the base with a ring or elevator system which protects the contents of the case by limiting the amount of air exposure on all sides.

In some embodiments, the cover (1) further comprises a valve seal ring (14) on the internal surface (15). The external periphery (25) of the valve seal ring is chamfered slightly, as shown in FIGS. 17-20, 34, 35, and 46. The internal periphery (23) of the lip of the recess is also chamfered slightly as shown in FIGS. 17-20, 34, 35, and 46, and configured to engage the external periphery of the valve seal ring (63). As the cover is pressed against the base, the valve seal ring is compressed into the lip of the recess, forming an airtight function in the recess.

In some embodiments, threads (21) are provided on the cover (1) to engage threads (11) provided on the wall (17) extended upwardly from the base. The cover is pressed against the base by engaging the threads on the cover and the threads on the base and rotating the cover and the base with respect to each other. This pressure is sufficient to engage the valve seal ring and the lip of the recess to form an airtight seal.

As shown in FIGS. 15-20, in some embodiments a mirror (27) is attached to the bottom of some embodiments of the invention. This has the dual purpose of providing the largest possible reflective surface without increasing the size of the compact, and hiding the openings formed at the bottom of the base. In addition, a mirror on the outside surface allows its use without having to open the case and unnecessarily expose the contents to air. In other embodiments, a mirror is affixed to internal surface 15. This embodiment is ideal for using the mirror while the case is opened, such as when applying makeup contained inside of the case. In other embodiments, a mirror is affixed to the top of the cover (64). This embodiment is useful as it combines the benefits of having a large surface area, the ability to use the mirror while using the contents of the case, and the ability to use the mirror without opening the case.

To open some embodiments of the invention, the cover and base are rotated with respect to each other until the threads on the cover disengage from the threads on the base, and then the cover is lifted to open the hinge between the cover and the intermediate ring. To close these embodiments, the cover is lowered and the cover and base are rotated with respect to each other until the threads engage and the cover is pressed sufficiently against the base to form an airtight seal between the valve seal ring and the lip of the recess.

In some embodiments, the function and structure of the hinge (7) and hinge pin (9) are replaced by a living hinge. This advantageously permits the cover (1) and the intermediate ring (3) to be molded or machined from a single piece of material, retaining a thin flexible diaphragm between the two. The cover and intermediate ring are folded together at the center of the diaphragm, leaving the diaphragm as a living hinge. This embodiment advantageously reduces the cost and complexity of manufacturing and is especially suited in smaller applications such as providing compacts for promotional samples of cosmetics. In some embodiments the living hinge remains external to the outer profile of the intermediate ring and the cover when the cover is closed. In other embodiments, the intermediate ring is provided with a depression into which the living hinge fits when the cover is closed, advantageously allowing a smooth external profile on the cosmetic case. In other embodiments, the cover is provided with a depression into which the living hinge fits when the cover is closed, while in still other embodiments, both the intermediate ring and the cover are provided with a depression, advantageously allowing a wider range of hinged motion between the intermediate ring and the cover while preserving a smooth profile to the outer surface of the cosmetic case when the cover is closed.

In other embodiments, the invention utilizes bayonet mounts rather than threads to press the cover to the base. In one embodiment, one or more lugs are formed on the inside of the cover, configured to engage corresponding slots formed in the base. Engaging the lugs with the slots and rotating the cover and base with respect to each other has the effect of tightening the cover onto the base. In another embodiment, the one or more lugs are formed on the base to engage corresponding slots in the cover. Other mechanisms for pressing the cover to the base including latches and spring clips can be envisioned without departing from the spirit of the invention.

In some embodiments, a manual vacuum break is provided. This is especially advantageous when the contents are fine dry powders. In these cases, the process of unscrewing the cover can form a vacuum inside the receptacle as the airtight seal is broken, and the inrushing air can scatter the contents. In other cases, the process of screwing down the cover to form the airtight seal compresses the air inside the container, leading to higher pressure inside the container than outside and potentially leading to blowing about of the powder as the pressure is released when the cover is open. By manually breaking the seal using a vacuum break before the cover is turned, such scattering is avoided. In some embodiments, the vacuum break is a channel through the cover of the case, held closed by spring tension and opened by depressing an actuator on the outside of the case. In some embodiments, the vacuum break is formed as an integral part of the cover and the spring tension is provided by the resilience and elasticity of the material from which the cover is formed.

In other embodiments, a one-way valve is provided. This can advantageously reduce the increase in pressure caused by screwing down the cover to form an airtight seal by allowing the air to escape as the cover is screwed down. The one-way valve allows air to escape from inside the container when the pressure inside is higher than the pressure outside, but prevents outside air from entering the container, thus preserving the contents.

Figure 34:
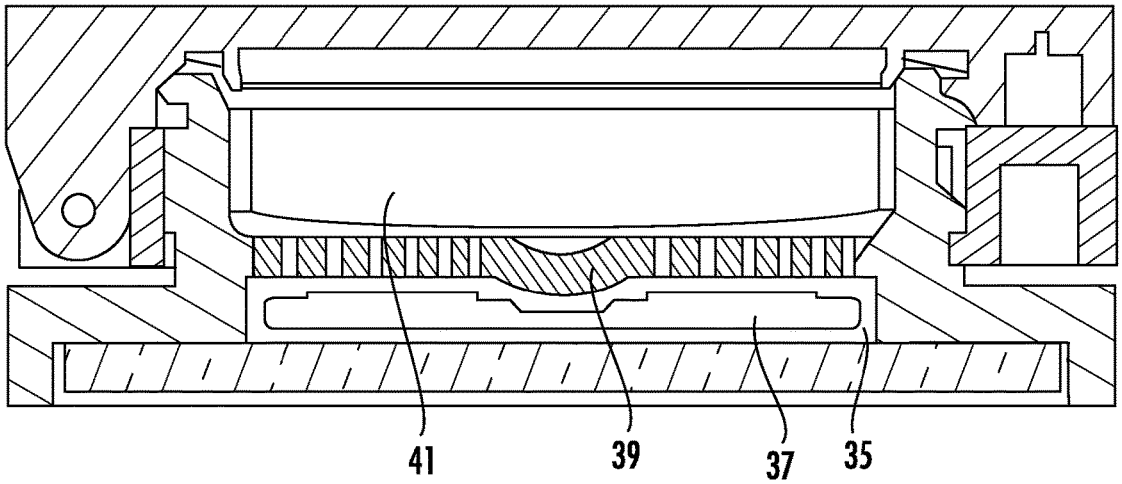
FIGS. 34 and 35 depict sectional views of embodiments of the invention shown in FIGS. 1 and 2.
Figure 35:
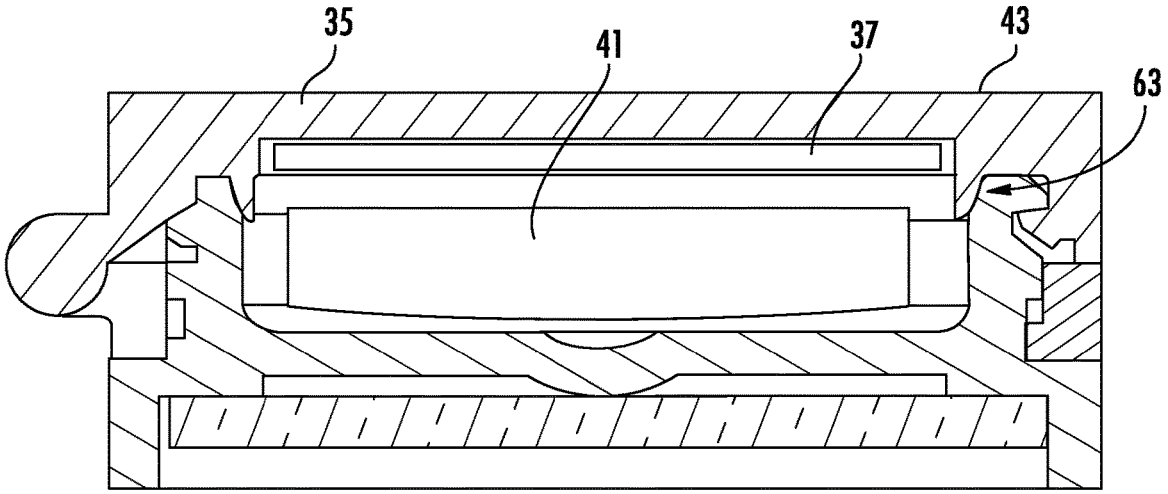
Figure 36:
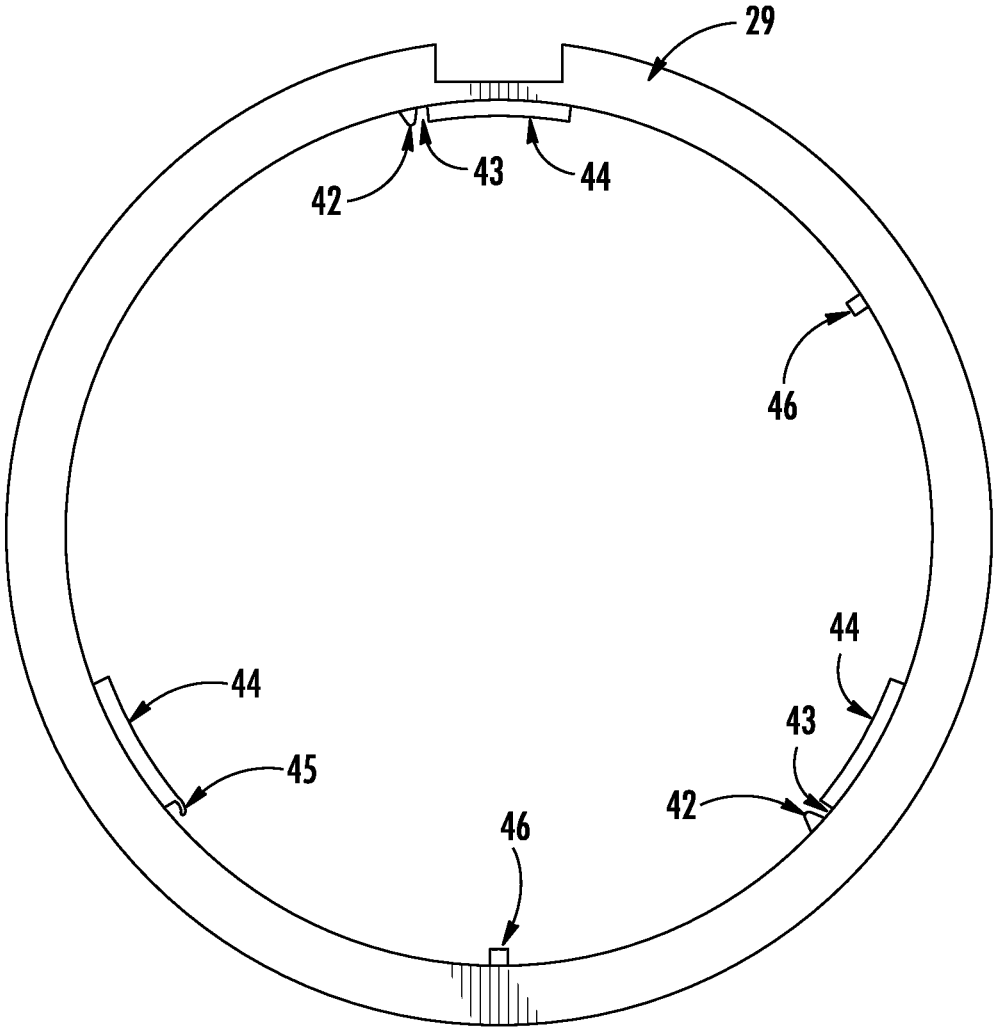
Figure 37:
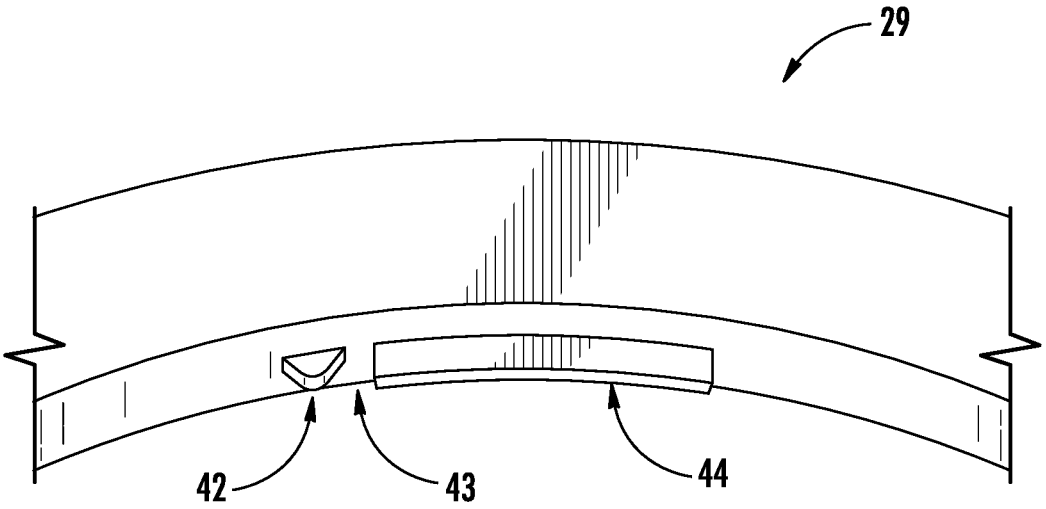
FIGS. 37 and 38 depict zoomed in views of the ring protrusion embodiments of the intermediate ring of the embodiments of the invention shown in FIGS. 1 and 2.
Figure 38:
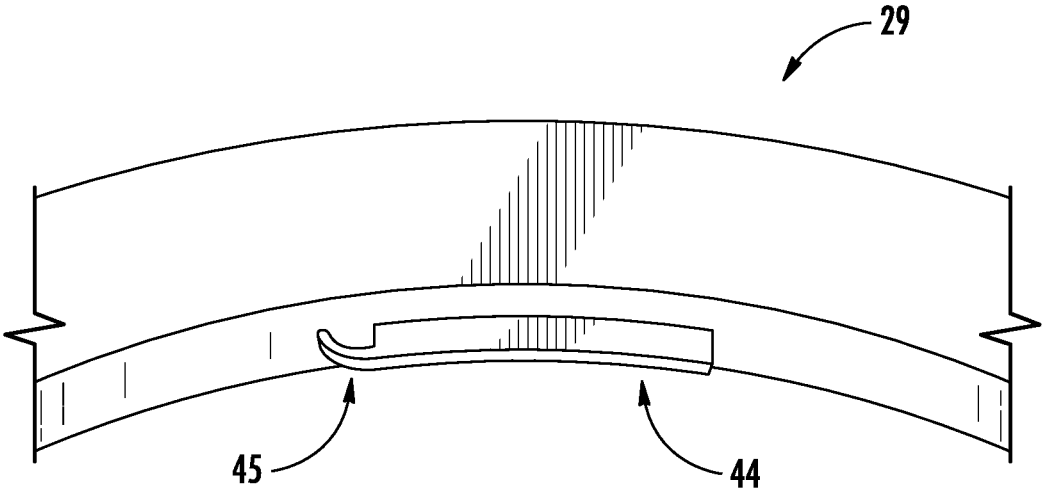

In other embodiments, a chamber (35) is provided in vapor contact with the recess when the airtight seal is engaged. In one exemplary embodiment, as shown in FIG. 34, the chamber is located in the base of the cosmetic case, beneath the recess containing the product. In a second exemplary embodiment, as shown in FIG. 35, the chamber is located in the cover, above the recess containing the product when the cosmetic case is sealed. This chamber is charged with a substance (37) for preserving the contents contained in the receptacle. In some embodiments, especially advantageous when the contents are in a dry powdery form, the chamber is charged with a desiccant. In varying embodiments, the desiccants are alternatively silica gel, magnesium sulfate, and sodium sulfate. The desiccant advantageously absorbs any water entering the cosmetic case when it is opened, preventing the cosmetic from absorbing water and caking up.

In other embodiments, especially advantageous when the cosmetic product is an aqueous paste, the substance is a water source, advantageously preventing the contents from drying out as water is lost when the container is opened. In one embodiment, the water source is water absorbed onto a suitable absorbent material such as cotton, cellulose, or hydrophilic sponge. In another embodiment the water source is a hydrated hydrophilic gel. In yet another embodiment, the water source is a solid such as clay, zeolite, calcium carbonate, or magnesium sulfate, the solid being in a hydrated form.

In still further embodiments, especially advantageous when the contents contain a volatile organic solvent such as hexane, ethyl acetate, ethyl alcohol, or isopropyl alcohol, the substance is a solvent compatible with that of the contents, the solvent absorbed onto a suitable absorbent material such as foam, cloth, or paper. In still further embodiments, the substance is alternatively a biocide, a bactericide, a fungicide, or combinations thereof, advantageously preventing biological contamination of the cosmetic product.

In some embodiments, cover 1 and base 5 consist of one material and in other embodiments cover 1 and base 5 consist of more than one material. In some embodiments, cover 1 and base 5 consist of one layer, and in other embodiments cover 1 and base 5 consist of more than one layer. In some embodiments the different layers are the same material, and in other embodiments the different layers are different materials. An example of the embodiment with different material layers is shown in FIG. 43 where cover 1 has an external layer 53, and base 5 has an external layer 55. The embodiments with different material layers are useful for allowing flexibility in the materials contained in the cosmetic case. Some of the solvents listed above are corrosive or damaging to certain types of materials. Thus, it is beneficial to be able to line the inside of the container with a material which is more durable, but may be more expensive or not as aesthetically pleasing, while maintaining a cheaper and more aesthetically pleasing external material.

In some embodiments, the substance is separated from the recess by a perforated divider (39) to prevent loss of the contents of the recess into the chamber. In other embodiments, especially advantageous when the contents are finely divided powders which might pass through a perforated divider, the substance is separated from the recess by a membrane (43) permeable to vapors but impermeable to finely divided solids, to prevent entry of the contents of the recess into the chamber.

These descriptions and drawings are exemplary of specific embodiments only and are not intended to be limiting to the scope of the invention defined in the claims.

What is claimed is:

1. A cosmetic case comprising:

a base having a recess defined by a recess wall;

a ring free to rotate about said recess wall and retained by said base;

a cover;

a hinge affixing said cover to said ring to form a cover assembly;

wherein rotation of said cover assembly about said recess wall forms an airtight seal between said base and said cover;

wherein said ring further comprises at least one ring protrusion;

wherein said base further comprises at least one base protrusion;

wherein at least one of said at least one ring protrusion engages with at least one of said at least one base protrusion to secure said cover assembly in a secured position;

wherein said base further comprises at least one riser such that during rotation of said cover assembly said at least one ring protrusion engages with said at least one riser and moves said cover assembly in a vertical direction.

2. A cosmetic case according to claim 1 where said secured position denotes an opened or closed position of said cover assembly.

3. A cosmetic case according to claim 1 where said at least one ring protrusion is selected from the group consisting of a bump, a ledge, a hook, and combinations thereof.

4. A cosmetic case according to claim 1 where said at least one base protrusion is selected from the group consisting of a bump, a ledge, a hook, and combinations thereof.

5. A cosmetic case according to claim 1, wherein said cover and said recess wall each further comprise mating threads such that engagement of said threads and rotation of said cover assembly draws said cover towards said base to form said airtight seal.

6. A cosmetic case of claim 1, further comprising:

a sealing element affixed to said cover, said sealing element having a chamfered perimeter;

a chamfer on said recess wall configured to mate with said chamfered perimeter on said sealing element to form said airtight seal.

7. A cosmetic case of claim 6 wherein said sealing element is selected from the group consisting of an annular gasket, a valve seal ring, a disc, and combinations thereof.

8. A cosmetic case of claim 1 wherein said case further includes a mirror affixed to said case.

9. A cosmetic case of claim 1 wherein said hinge has an outer profile which substantially matches a profile of an outer diameter of said ring, and said hinge in the closed position is contained within said outer perimeter of said ring.

10. A cosmetic case according to claim 1, wherein said cover and said base are made of at least two layers, wherein each layer is made of a material different than another layer.

11. A cosmetic case according to claim 1 wherein said hinge is a living hinge.

12. A cosmetic case according to claim 11 wherein said living hinge has an outer profile which substantially matches a profile of an outer diameter of said ring.

13. A cosmetic case according to claim 12 wherein said living hinge remains external to said outer profile of said ring and said cover when said cover is closed.

14. A cosmetic case according to claim 11, further comprising a depression.

15. A cosmetic case according to claim 14 wherein said living hinge fits in said depression.

16. A cosmetic case according to claim 1 wherein bayonet mounts are used to press said cover to said base.

17. A cosmetic case according to claim 1 wherein a manual vacuum break is provided.

18. A cosmetic case according to claim 1 wherein a one-way valve is provided.

19. A cosmetic case according to claim 1 wherein a chamber is provided in vapor contact with said recess when said airtight seal is engaged.

20. A cosmetic case according to claim 19, wherein said chamber is located in said cover.

* * * * *